US005489140A

United States Patent [19]

Van Horn-Plato

[11] Patent Number: 5,489,140

[45] Date of Patent: Feb. 6, 1996

[54] PORTABLE BEAUTICIAN'S CHAIR

[76] Inventor: Joan Van Horn-Plato, 4602 E. Joan De Arc, Phoenix, Ariz. 85032

[21] Appl. No.: 233,352

[22] Filed: Apr. 26, 1994

[51] Int. Cl.[6] ..... A47C 3/00

[52] U.S. Cl. ..... 297/310; 297/423.21; 297/182

[58] Field of Search ..... 297/310, 270, 297/239, 130, 154, 155, 188.04, 217.1, 217.7, 423.12, 423.11, 423.13, 423.21, 391, 182, 163

[56] References Cited

U.S. PATENT DOCUMENTS

| | | | |
|---|---|---|---|
| 3,371,959 | 3/1968 | Gordin | 297/310 |
| 4,123,102 | 10/1978 | Landry et al. | 297/310 |
| 4,240,662 | 12/1980 | Anderson | 297/182 |
| 4,630,862 | 12/1986 | Watanabe | 297/163 |
| 4,795,209 | 1/1989 | Quinlan et al. | 297/155 |
| 5,255,957 | 10/1993 | Opsvik et al. | 297/423.13 |
| 5,362,079 | 11/1994 | Graham | 297/217.1 |

*Primary Examiner*—Peter R. Brown
*Assistant Examiner*—Anthony D. Barfield
*Attorney, Agent, or Firm*—Basile and Hanlon

[57] ABSTRACT

A portable, lightweight, swivelable, elevatable and tiltable beautician's application chair is equipped with a pair of pneumatic tire transport wheels and a retractable pull tongue. The invention is equipped with an elevatable neck rest, a faucet-attachable water hose and a rearward tilt retainer to serve hair washing and coloring applications. It also incorporates a retractable back shelf for placement of hair drying equipment and supplies and a retractable lap shelf to serve fingernail grooming applications. A second embodiment of the invention eliminates the pneumatic tire transport wheels and pull tongue.

4 Claims, 5 Drawing Sheets

PORTABLE BEAUTICIAN' S CHAIR

FIELD OF THE INVENTION

The present invention relates to portable chairs, and, more particularly to such a chair useful in rendering beautician services.

BACKGROUND OF THE INVENTION

Because of increasing numbers of home-confined elderly women and working women, there is an increasing need for in-home beautician service. The number of elderly women crippled with arthritis and other causes is increasing, as is the number of those who are convalescing. Still further, because of greater longevity, more and more elderly women are infirm. These women tend to become depressed and bored, emphasizing the need for in-home beautician service as a means for "lifting their spirits".

Increasingly, women with children are employed outside the home, and therefore endeavor to minimize non-employment outside activities. Thus, in-home beautician service serves their desires.

Absence of means for rendering beautician service within homes derives mainly from the feeling that, like conventional beauty shop equipment, in-home beautician service equipment would be too cumbersome and heavy to transport to and within homes. Secondly, there is probably a failure to appreciate the increasing market for in-home beautician service, as described above.

SUMMARY OF THE INVENTION

The aforementioned limitations of present beautician service art are overcome by the present invention, basically, by providing a lightweight and portable beautician chair equipped to effect all beautician activities. Basically, the preferred embodiment of the invention includes a relatively light conventional caster-mounted office chair upholstered in leatherette for sanitary reasons. Modifications and interfaces thereof include, mainly; substantially raising the seat relative to the base and providing a rearward tilt retainer to serve the hair washing and coloring applications; provision of a pair of pneumatic tire transport wheels and a pull tongue to enable the unit to be conveniently pulled to and within homes; providing a retractable neck rest for use in hair washing and coloring applications; providing a retractable back shelf to support hair dryer equipment and supplies; and provision of a retractable lap shelf to be used for fingernail manicuring.

Upon arriving at the location of application of the invention the ottoman, hair dryer equipment and supplies are secured atop the invention's seat. The beautician then renders the pull tongue functional, grasping its handle and raising the front portion of the unit to thereby enable the pneumatic tire wheels to bear the load. The unit is then pulled to and within the house, easily traversing stairs as necessary.

The invention's second embodiment is similar to the preferred embodiment, incorporating the same interfaces and beautician service operating principles. However, it eliminates the pneumatic tire transport wheel assembly and the pull tongue. Because of these eliminations the unit would be manually carried into and out of the home. Similarly, the ottoman, hair dryer equipment and supplies would be manually carried rather than carried atop the seat, as in the first preferred embodiment.

BRIEF DESCRIPTION OF THE DRAWINGS

Other objects, features and advantages of the present invention will become apparent by reference to the following detailed description and drawings, in which.

DESCRIPTION OF THE PREFERRED EMBODIMENTS

Figure 1:
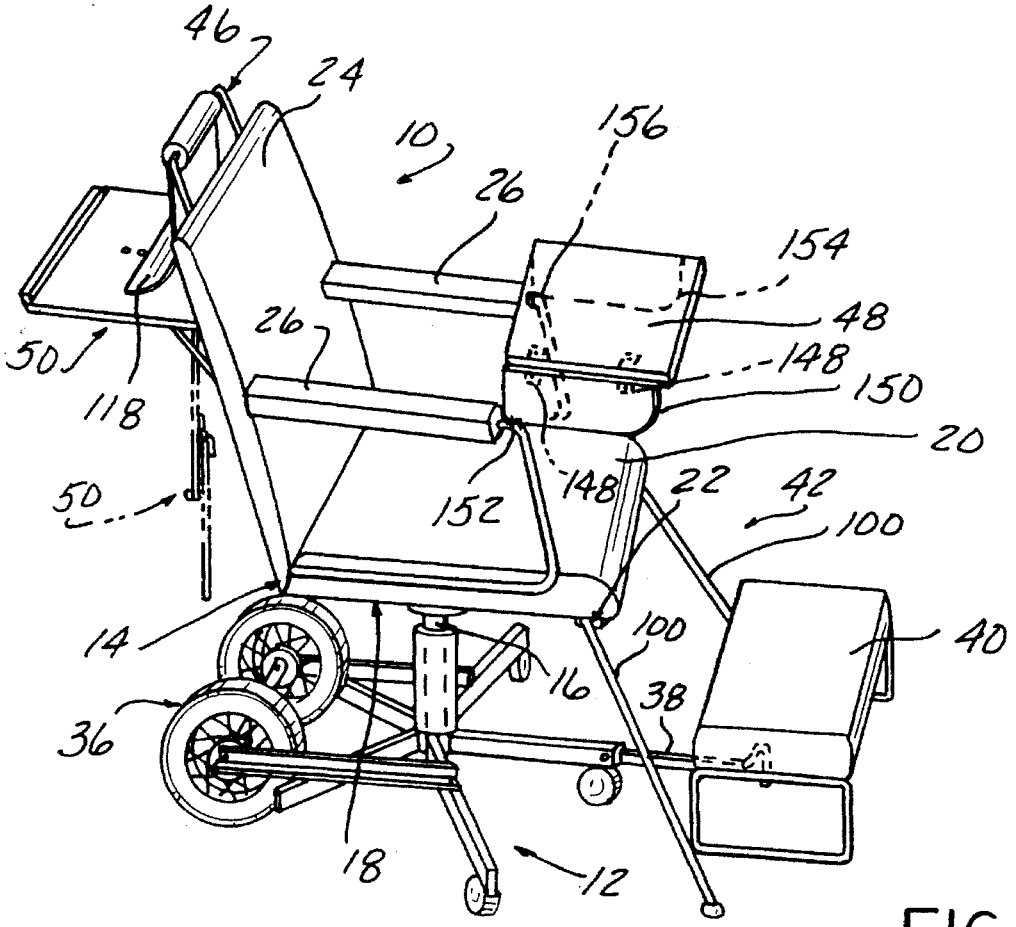
FIG. 1 is a side perspective view of the invention in the hair drying, cutting, permanent waving and fingernail grooming modes.

In FIG. 1, it can be observed that the first embodiment of the present invention basically incorporates a conventional, leatherette-upholstered (for sanitary reasons), office-type swivel/tilt chair comprising a seat assembly designated generally 10 swivel-mounted upon a conventional base assembly designated generally 12.

Seat assembly 10 basically includes a frame 14, a swivel/tilt mechanism 16 mounted centrally on and downwardly projecting from a lower horizontal panel 18 of the frame, a seat 20 disposed upon horizontal upper panel 22 of the frame 14 and a pair of arm assemblies 26 assembled to the frame.

Figure 2:
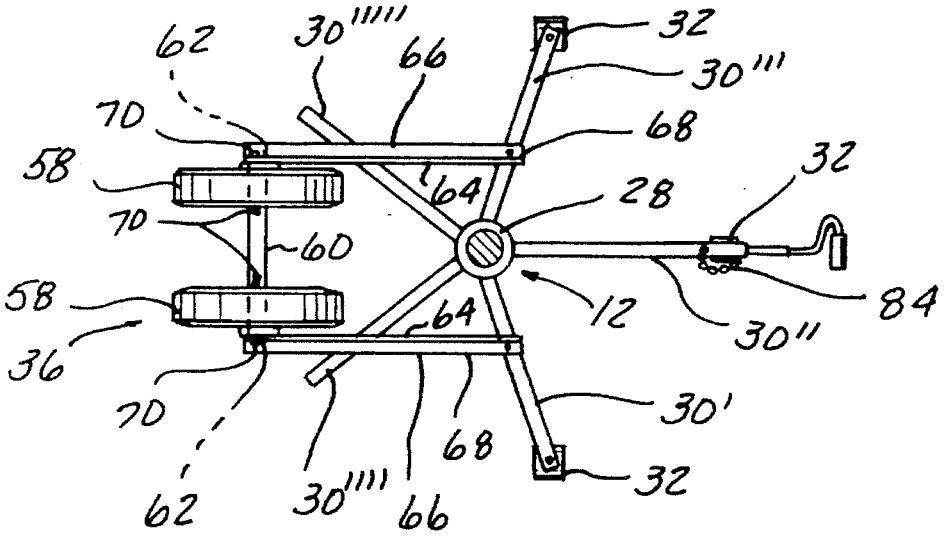
FIG. 2 is a top plan view of the base assembly.

Base assembly 12, as best seen in FIG. 2, basically includes a central metal hub 28, a plurality of equally-spaced, horizontally-extending, rectangular tubular metal legs designated generally 30 welded to hub 28, and casters 32 pivotally-assembled beneath the ends of legs 30', 30" and 30'". Whereas they are preferred, casters 32 are not a necessary part of the present invention.

Returning to FIG. 1, adaptations of the illustrated conventional chair, as preferred for the invention, may include: spacer block 34 (FIG. 3); transport wheel assembly designated generally 36; pull tongue 38; ottoman 40; tilt retainer designated generally 42; water hose 134 (FIG. 10); neck rest assembly designated generally 46; lap shelf 48 and back shelf assembly designated generally 50.

Figure 3:
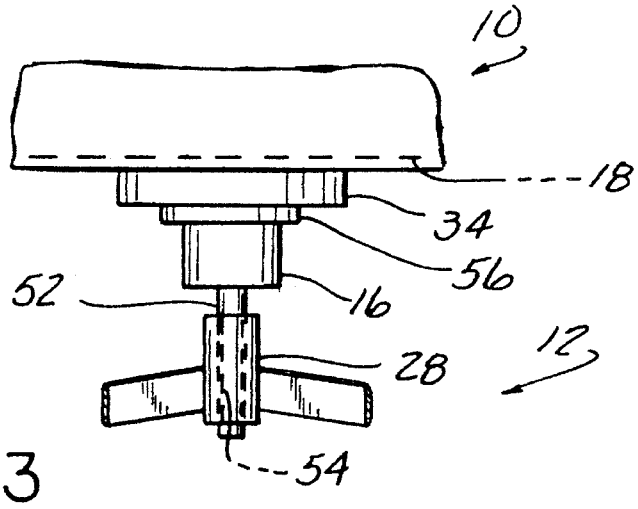
FIG. 3 is a partial side view of the invention, detailing assembly of the seat and base assemblies.

As shown in FIG. 3, seat assembly 10 assembles to base assembly 12 via metal shaft 52 which projects downwardly from swivel/tilt mechanism 16 and is received through hole 54 of hub 28 of base assembly 12. As thus assembled, seat assembly 10 may be swiveled, tilted, elevated or lowered in accordance with various conventional designs of swivel/tilt mechanism 16. As a means of further increasing maximum elevation of seat assembly to facilitate the invention's hair washing and coloring applications, wooden spacer block 34 is interposed between mounting plate 56 of mechanism 16 and the mechanism's supporting lower panel 18 of the chair frame.

In FIG. 2, it can be seen that transport wheel assembly 36 comprises a pair of scooter-size pneumatic tire wheels 58 rotatably assembled to steel axle 60 having its ends fixedly disposed through axially-aligned holes 62 of vertical webs 64 of right-angle-formed steel brackets 66, near the forward ends of the brackets. Brackets 66 are parallel-oriented and their horizontal webs 68 are welded atop the free ends of legs 30"" and 30"" and atop opposing legs 30' and 30"', respectively. Transverse movement of wheels 58 relative to axle 60 is constrained via cotter pins 70 assembled through axle 60, immediately outboard and inboard adjacent to wheels 58.

Figure 4:
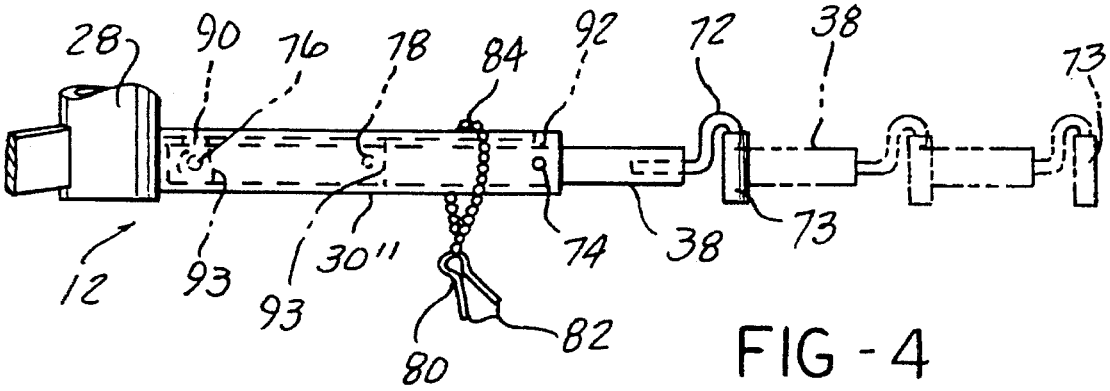
FIG. 4 is a cutaway detailed side view of the leg and pull tongue assembly, showing various positions of the pull tongue in phantom.

Now referring to FIG. 4, it can be observed that pull tongue 38 slidably disposes within metal tubular leg 30" of base assembly 12. Metal, rectangle cross-sectioned tongue 38 incorporates a formed, round cross-sectioned steel handle 72 threadably assembled normal to its forward end. A conventional rubber handle bar cover 73 is assembled over the free end of handle 72.

Leg 30" incorporates a pair of axially-aligned holes 74 passing through its side walls near its forward end. Tongue 38, in turn, incorporates a first and a second hole 76 and 78, each of diameter slightly greater than that of leg holes 74, which can be axially-aligned with leg holes 74. As a means for retaining the extended positions shown in phantom of tongue 38 relative to leg 30", cotter-type steel lock pin 80 is provided. Pin 80 is selectively insertable through holes 74 of leg 30" and either hole 76 or 78 of tongue 38. As a means for insuring against unwanted disassembly of pin 80 from leg 30" and tongue 38, the free ends of the pin's tines 82 are moderately separated, so they will bear against the wall of inboard hole 74 of leg 30". Still further, to insure against loss of pin 80, it is connected to ball chain 84 which assembles around leg 30". Finally, provision is made to prevent disassembly of tongue 38 from leg 30", which could result in damage of the invention as it is being pulled. Thus, the height of tongue 38 is one-quarter inch less than the inner height of leg 30". A first short, round steel stop pin 90 is press fitted normal to the upper surface of tongue 38, near its rearward end, and a second such pin 92 is welded normal to the inner-upper surface of leg 30", near its free end. Since pins 90 and 92 are engageable with one another, they insure that tongue 38 will remain captured by leg 30". Tongue hole 76 is employed by pin 80 when the invention is being transported up or down stairs. Either tongue hole 76 or 78 may be employed when transporting the unit on level surfaces. To facilitate axial alignment of the unseen holes 76 and 78 of tongue 38 with holes 74 of leg 30", lines 93 may be scribed on the tongue 38, at locations such that they will be immediately adjacent to the free end edge of leg 30" when leg holes 74 align with tongue holes 76 and 78, respectively.

Figure 5:
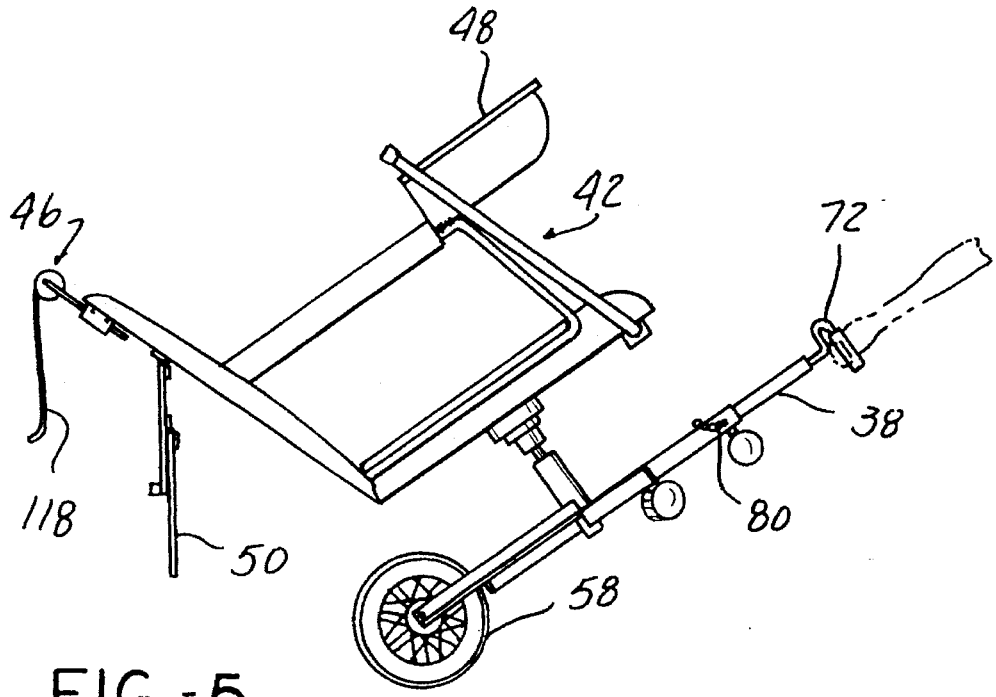
FIG. 5 is a side view of the invention being transported.

FIG. 5 illustrates the invention being transported. While not shown, for clarity of illustration, in the transport mode ottoman 40 (FIG. 1) would rest upside down upon seat 20 and the hair dryer equipment and supplies would rest upon the under surface of ottoman 40. Whereas tilt retainer 42, neck rest assembly 46 and back shelf assembly 50 are in non-functional positions, as a means for facilitating passage of the unit through doorways lap shelf 48 is in its functional position.

Figure 6:
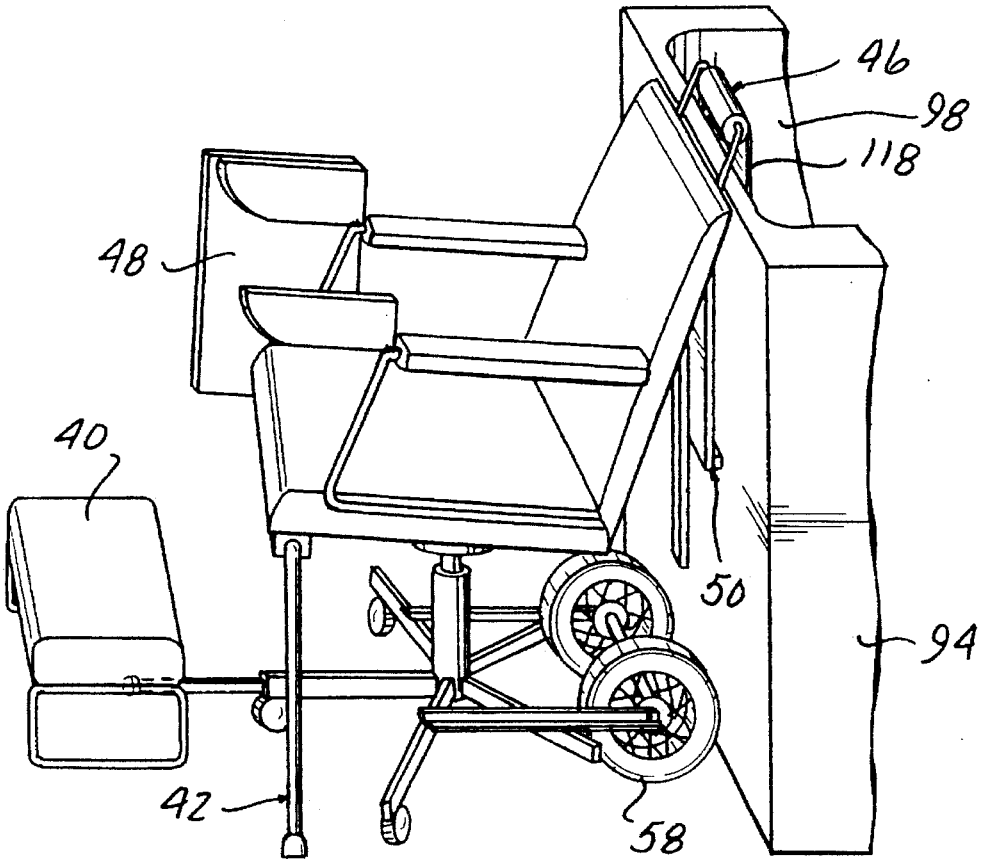
FIG. 6 is a side perspective view of the invention in the hair washing and/or coloring mode.

FIG. 6 shows the invention in the hair washing or coloring application, with transport wheels 58 bearing against sink cabinet 94 and with tilt retainer 42 both elevating the front of the unit and constraining it from forward movement away from sink cabinet 94. It is to be noted that the rearward tilt of the invention effected by tilt retainer 42 enables the elevated neck rest assembly 46 to accommodate the occupant's head at a position which facilitates proper drainage of water via drain sheet 118, from the head into sink 98. Note that ottoman 40 is functional, while lap shelf 48 and back shelf assembly 50 may be in non-functional positions.

Figure 7:
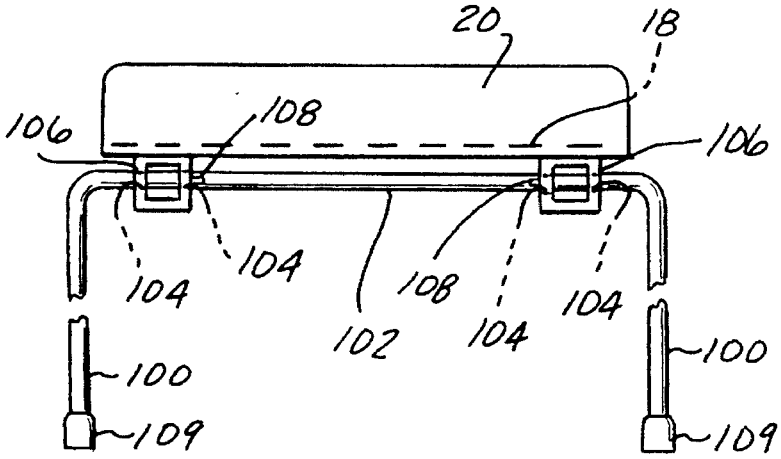
FIG. 7 is a front view of the rearward tilt retainer.

The design of rearward tilt retainer 42, specified in FIG. 7, takes the form of a "U"-formed round metal tube comprising a pair of parallel-oriented legs 100 joined by cross portion 102. Cross portion 102 pivotally disposes through axially-aligned holes 104 near the forward ends of a pair of parallel-oriented brackets 106. The brackets, preferably made of rectangle tubular metal, assemble to the under surface of lower panel 18 of the chair frame, the forward ends of brackets 106 being even with the forward edge of panel 18. Cotter pins 108, assembled to cross portion 102 of retainer 42, just inboardly adjacent to brackets 106, serve to constrain transverse movement of the retainer relative to the brackets. The ends of retainer legs 100 are covered with rubber members 109, which both protect the floor from scratches and frictionally prevent displacement of legs 100 relative to the floor when the retainer is in its rearward chair tilt retaining mode.

Figure 8:
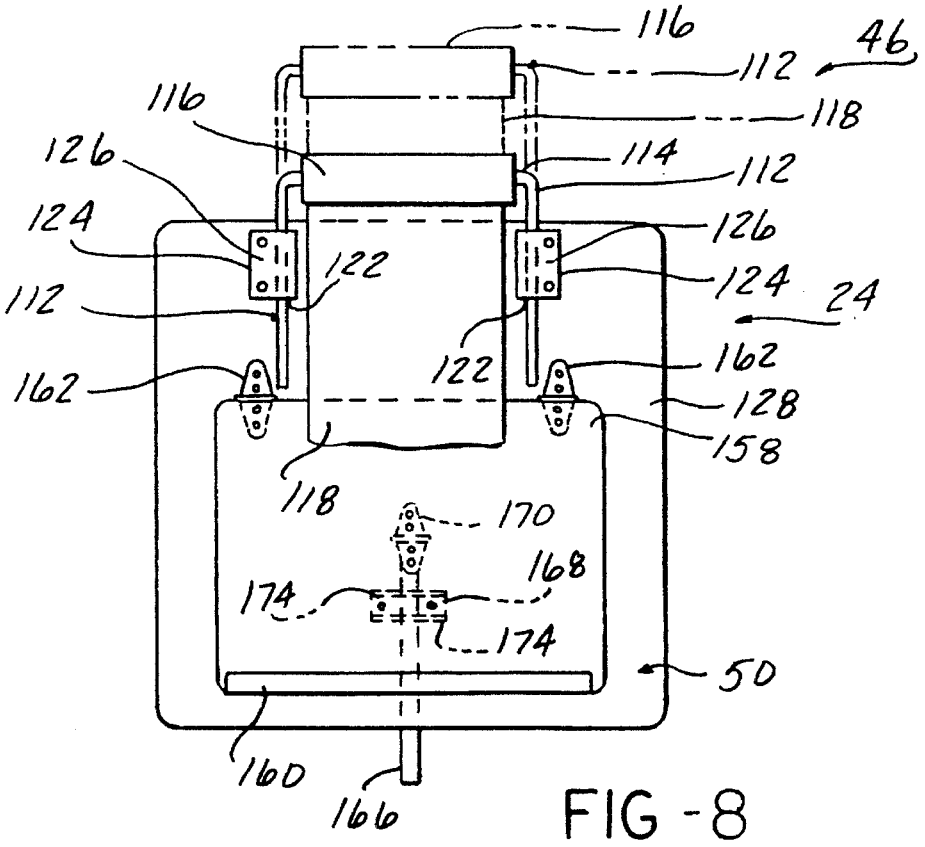
FIG. 8 is a detailed rear view of the neck rest and back shelf assemblies.
Figure 9:
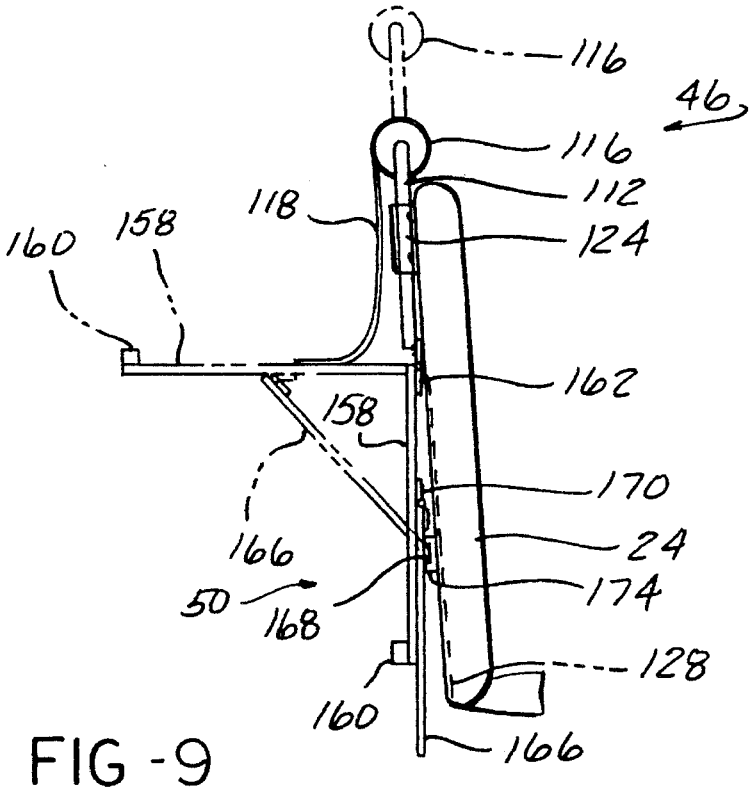
FIG. 9 is a detailed side view of the neck rest and back shelf assemblies.

FIGS. 8 and 9 specify designs of neck rest and back shelf assemblies, respectively. Upholstery (not shown) covers the parts which assemble to rear panel 128 of the chair frame. Neck rest assembly 46 includes a "U"-formed steel member comprised of a pair of parallel-oriented legs 112 joined by a concavely-formed (relative to the occupant's neck) cross portion 114. Portion 114 is covered by resilient, foam-type plastic 116 which, in turn, is covered by the upper end of a resilient plastic water drain sheet 118, the free end of which disposes into the sink, as seen in FIG. 6. Neck rest assembly legs 112 are slidably received by tubular portions 122 of a pair of parallel and vertically-oriented metal brackets 124, the flat portions 126 of which assemble to the outer surface of the near upper end of rear panel 128 of the chair frame. As shown in phantom, neck rest assembly 46 may be raised and frictionally retained at various heights required for hair washing or coloring, dependent on the height of the occupant.

Figure 10:
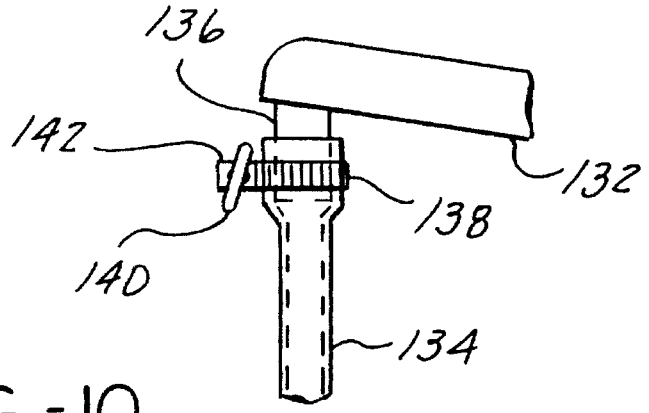
FIG. 10 is a detailed side view of the water hose and its connection to the sink faucet.

As shown in FIG. 10, as a means for conveniently flowing water from the sink faucet 132 to the subject's head, a plurality of water hoses 134 of differing attachment end inside diameters are provided to be selectively fitted over faucet exits 136 of differing outside diameters. In order to prevent leakage of water at the hose and faucet connection, a hose clamp 138 of conventional design assembles over the attachment ends of the hoses 134. To facilitate tightening of the clamp a forefinger and thumb-actuable member 140 is welded normal to the clamp's screwdriver-actuable tightening member 142.

Returning to FIG. 1, the invention is shown as it would be employed in the hair drying, cutting and permanent waving applications, also the fingernail grooming application. Lap shelf 48 may be rendered non-functional, hanging alongside the chair, as shown in FIG. 6, if the fingernails are not to be manicured. Back shelf 50 may be rendered non-functional, hanging at the back of the chair, as shown in broken line, if only the fingernails are to be manicured. It can be seen that the rearward tilt retainer 42, employed in the hair washing and coloring applications, is in a non-functional position with legs 100 resting on the floor in front of the invention. The main use of back shelf 50 is to support hair drying equipment.

Lap shelf 48 assembles via a pair of steel hinges 148 to a vertically-oriented flat steel plate 150 welded to right hand arm rest rail 152 of arm rest assembly 26. A second, like-designed plate 154, not having attached hinges, and similarly welded to left hand arm rest rail 156 of arm rest assembly 26, supports the free end of shelf 48 when it is in the illustrated functional fingernail manicuring position.

In FIGS. 8 and 9, it can be seen that back shelf assembly 50 includes a wide and flat rectangular panel 158 and a narrow, strip-formed ledge 160 affixed to the outer edge of its upper surface. Panel 158 assembles to the outer surface of rear panel 128 of back 24 via a pair of steel hinges 162. As a means for retaining panel 158 in its illustrated (FIG. 9) horizontal (functional) position, support rod 166 and rod catch 168 are provided. Narrow, flat metal rod 166 connects to panel 158 via a steel hinge 170 assembled centrally to the under surface of the panel. Rod catch 168 takes the form of a short piece of generally "U" shaped steel channel with a pair of screw assembly holes. It assembles horizontally to the lower central outer surface of rear panel 128 of the chair frame at a position which enables support rod 166 to maintain panel 158 in the horizontal and hence functional position, as shown in phantom in FIG. 9. It can be noted that the downward force exerted by support rod 166, resulting from the load on panel 158, insures that the rod's lower end will remain disposed between lips 174 of rod catch 168 (FIG. 8), thereby retaining panel 158 in the functional position. Note further that back shelf assembly 50 can be returned to its non-functional position, hanging from chair back 24, by merely lifting panel 158 to thus allow the lower end of support rod 166 to disengage rod catch 168.

Figure 11:
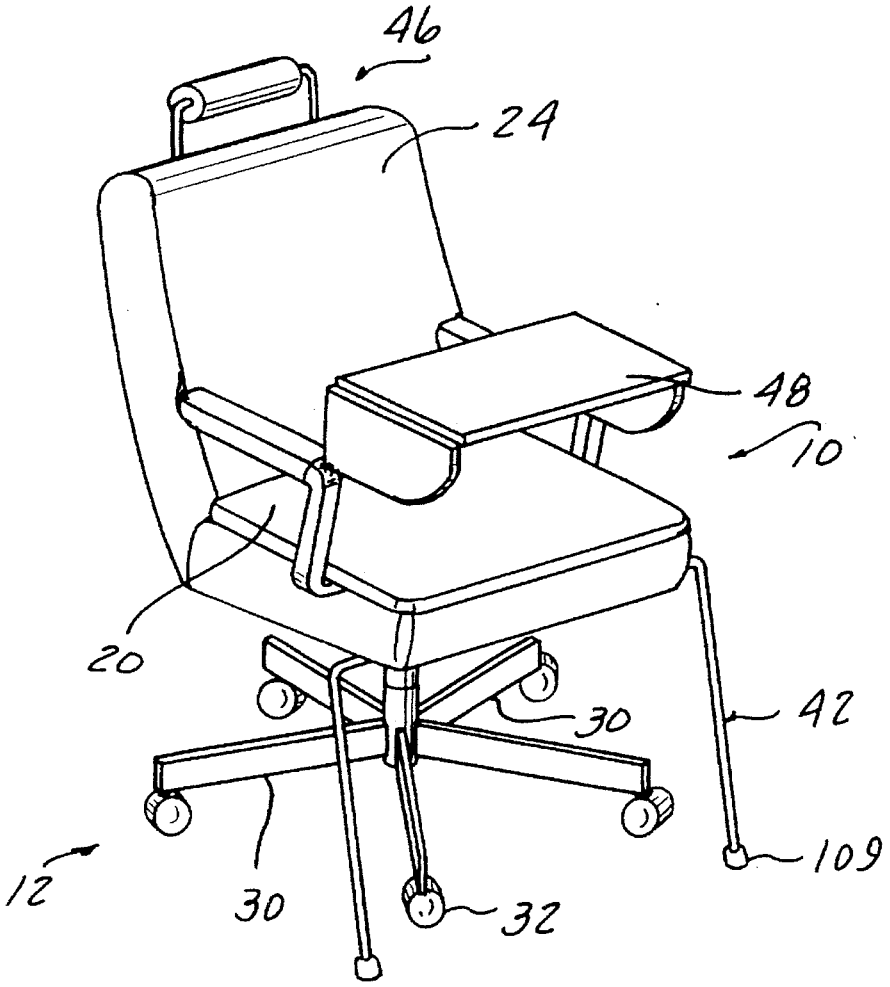
FIG. 11 is a front-side perspective view of a second embodiment of the invention.

The invention's second embodiment is shown, without ottoman 40, in FIG. 11, where it can be observed that the unit does not incorporate transport wheel assembly 36 and tongue 38. Because of these eliminations, all of legs 30 are equipped with casters 32. Also, because of these eliminations the invention would be manually carried into the home. Similarly, ottoman 40, hair dryer equipment and supplies would be manually carried rather than carried atop seat 20, as in the first preferred embodiment.

OPERATION OF THE INVENTION

Upon arriving at the location of the invention's application, the ottoman 40, hair dryer equipment and supplies would be secured atop the seat 20, after which the lap shelf 48 would be pivoted to its functional position to facilitate the unit's clearance through doorways. Finally, as shown in FIG. 5, the rearward tilt retainer 42 would be pivoted upwardly to a non-functional position and the pull tongue 38 would be pulled out and secured with lock pin 80.

The pull tongue handle 72 would then be grasped and lifted, to thus enable the pneumatic tire transport wheels 58 to bear the load. The unit would then be pulled, over curbing and steps as necessary, to the home entrance. The unit would be pulled or pushed along the floor and would be pulled up stairs or "led" down stairs as necessary. The term "led", as used here, means allowing the unit to proceed in front of the handler.

If the subject's hair is to be washed and/or colored, as shown in FIG. 6, the unit would be pushed to abut its pneumatic tire wheels 58 against the kitchen or bathroom sink cabinet 94. The water hose 134 would then be clamped to the faucet exit 136. The ottoman 40, hair dryer equipment and supplies would be removed from the seat 20 and the seat assembly 10 would be raised to its highest elevation via swivel/tilt mechanism 16. The lap shelf 48 would be returned to its non-functional position and the subject would then be seated. The neck rest 46 would be raised to comfortably abut the back of the neck, the neck rest-attached water drain sheet 118 would be draped into the sink, the rearward tilt retainer 42 would be rendered functional to both raise the front of the unit and also prevent possible forward movement away from the sink, and the ottoman 40 would be placed for comfortable support of the feet.

As shown in FIG. 1, following the hair washing and/or coloring application, the rearward tilt retainer 42 would be rendered non-functional, the neck rest 46 would be lowered and the back shelf 50 would be raised and secured in its functional position to support the hair drying equipment. If the fingernails are to be manicured separately or simultaneously with hair drying, cutting, styling or permanent waving, the lap shelf 48 would be pivoted to its functional position above the lap for placement of the hands thereon.

Preparatory to exiting the unit from the home, the seat assembly 10 would be lowered to its lowest elevation, the ottoman 40, hair dryer equipment and supplies would be secured atop the seat, the lap shelf 48 would be swung into its functional position and the rearward tilt retainer 42 would be swung up into a non-functional position. Upon returning to the car or truck, the ottoman 40 and dryer equipment would be loaded therein, as would the seat 10 and base 12 assemblies, either assembled or separately.

The invention's second embodiment, illustrated in FIG. 11, is designed similarly to the preferred embodiment, except for its elimination of the transport wheel assembly 36 and the pull tongue 38. As a result of these eliminations, all of the legs 30 would retain their conventional casters 32 if the invention is caster-equipped.

It is to be understood that, in both the first and second embodiments, for all the various assemblies and mechanisms described, that those described are preferred. However, it is to be further understood that any suitable means may be employed for these various assemblies, and such suitable means are contemplated as being within the scope of the present invention.

While exemplary embodiments of the invention have been disclosed, it will be apparent to those skilled in the art that the described embodiments may be modified. Therefore, the foregoing description is to be considered exemplary rather than limiting, and the true scope of the invention is that defined in the following claims.

What is claimed is:

1. A portable beautician's chair, comprising:

a frame having a plurality of spaced apart legs supporting the chair for movement over a floor in a stable, upright configuration;

means, attached to the legs, for providing rolling movement across the floor;

means for sitting, the sitting means being rotatably supported from the frame;

means, operatively attached to the frame, for selectively positioning the sitting means at a desired sitting position, the selective positioning means providing both height and pivot adjustment;

means, disposed at a rearward portion of the frame, for supporting a person's back area;

means, attached to the frame, for supporting a person's arms;

means, attached to the frame, for supporting a person's neck;

means, attached to the arm support means, for supporting the person's forearms and hands in a position spacedly opposed to and parallel to the person's lap, the forearm support means for aiding in the provision of manicure services, wherein the forearm support means comprises a shelf, hingedly and pivotably attached to, and extendable laterally between the arm support means;

means for supporting a person's feet, wherein the feet support means comprises an ottoman;

means, attached to the frame, for releasably securing a desired pivot position, wherein the releasable pivot securing means comprises:

two rods, each having floor contacting ends, interconnected by a cross bar, the cross bar pivotally connected underneath the sitting means; and a slip-resistant polymeric cover attached to the floor contacting ends of each of the rods;

means, attached to the frame, for easing in long distance transport of the chair, wherein the transport easing means comprises:

pneumatic tire wheels; and a bracket assembly for attaching the tire wheels to two of the frame legs;

means, attached to a rear surface of the back support means, for holding beautician utensils; and means, operatively attached to the neck support means, for draining water from a person's head into a sink.

2. A portable beautician's chair, comprising:

a plurality of spaced legs mounted to a central hub;

a swivel/tilt mechanism rotatably assembled upon said hub and supporting a chair frame having a front portion, the chair frame equipped with a seat and seat back and pair of armrests;

a spacer block interposed between said mechanism and said frame to substantially elevate said frame in a high-chair arrangement;

a U-shaped frame having a cross member and legs extending therefrom, said cross member mounted to the front portion of said chair frame and having its legs pivotal from forward positions to a substantially vertical, floor contacting position effecting substantial rearward tilt of said chair frame;

a shelf having opposed first and second ends, the first end of said shelf being assembled to one of said armrests, said shelf being selectively pivotal from a substantially vertical, hanging position to a substantially horizontal position at which its second end rests upon the other of said armrests;

a pivotal support rod-equipped shelf assembled to said seat back and selectively pivotal from a substantially vertical, hanging position to a substantially horizontal position maintained by said rod which releasably assembles in a nest mounted to said seat back;

a U-shaped member having substantially vertically oriented legs slidably assembled to said seat back and an upper, contoured and cushioned, occupant neck-supporting cross member extending between said vertically oriented legs; and a resilient water drainage sheet having opposed first and second ends, the drainage sheet assembled at its first end to said neck-supporting cross member and insertable at its second end into a sink.

3. The portable beautician's chair as defined in claim 2, further comprising:

means for moving the chair, said moving means comprising a pair of scooter-size pneumatic tire wheels, axle assembled to brackets mounted to at least one of said legs; and means for pulling and pushing the chair.

4. The portable beautician's chair as defined in claim 3 wherein said central hub has a front, and wherein said pulling and pushing means comprises a handle-equipped rod slidably assembled in alignment with one of said legs opposite said pneumatic tire wheels and selectively advanceable from a retracted position to positions adapted to lift the front of said central hub to thereby transmit the chair's weight to be borne by said pneumatic tire wheels, adapted for movement of the chair during which said handle-equipped rod remains aligned with said one leg.

* * * * *